US007425149B2

(12) United States Patent
Hofler et al.

(10) Patent No.: US 7,425,149 B2
(45) Date of Patent: Sep. 16, 2008

(54) CONNECTION SYSTEM FOR CONNECTING A FLAT BLOCK OF COMPONENTS TO AN APPARATUS

(75) Inventors: Siegfried Hofler, Neunkirchen (DE); Stefan Nowak, Hessdorf (DE); Wieland Portisch, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/588,241

(22) PCT Filed: Dec. 29, 2004

(86) PCT No.: PCT/EP2004/053725

§ 371 (c)(1),
(2), (4) Date: Aug. 1, 2006

(87) PCT Pub. No.: WO2005/076412

PCT Pub. Date: Aug. 18, 2005

(65) Prior Publication Data

US 2007/0134992 A1 Jun. 14, 2007

(30) Foreign Application Priority Data

Feb. 4, 2004 (DE) ..... 10 2004 005 545

(51) Int. Cl.
*H01R 31/08* (2006.01)

(52) U.S. Cl. ..... 439/511; 439/709

(58) Field of Classification Search ..... 439/511, 439/502, 212, 627, 709, 721–723, 65, 74
See application file for complete search history.

(56) References Cited

U.S. PATENT DOCUMENTS

| | | | | |
|---|---|---|---|---|
| 2,862,995 | A * | 12/1958 | Hercules | 174/99 B |
| 3,164,709 | A * | 1/1965 | Gentile | 200/281 |
| 4,812,130 | A | 3/1989 | Altenschulte | |
| 5,202,538 | A * | 4/1993 | Skirpan | 174/661 |
| 5,326,285 | A * | 7/1994 | Maros | 439/717 |
| 5,411,418 | A | 5/1995 | Welsh et al. | |

(Continued)

FOREIGN PATENT DOCUMENTS

WO WO 02/089260 A3 11/2002

OTHER PUBLICATIONS

Zero insertion Force website page: http://de.wikipedia.org/wiki/Zero_insertion_Force , Aug. 9, 2006 (and similar English edition).

(Continued)

*Primary Examiner*—Michael C Zarroli
(74) *Attorney, Agent, or Firm*—Brinks Hofer Gilson & Lione

(57) ABSTRACT

A connection system that couples a contact of a flat block of components to an apparatus is provided. The connection system comprises a conductive connecting element electrically coupled to the contact of the flat block of components, and a clamping device electrically coupled to the apparatus. The clamping device receives the connecting element. The connecting element is a rigid conductor. The rigid conductor is a screw fastened conductively to the contact. The screw penetrates a bore in the flat block of components and is locked by a nut on a second side of the flat block of components, which is opposite a first side of the flat block of components.

21 Claims, 1 Drawing Sheet

U.S. PATENT DOCUMENTS

| | | | | |
|---|---|---|---|---|
| 6,036,508 | A | 3/2000 | Anderson et al. | |
| 6,066,006 | A | 5/2000 | Shaw | |
| 7,097,502 | B2 * | 8/2006 | Landis et al. | 439/595 |
| 7,112,741 | B2 * | 9/2006 | Hechler | 174/50 |

OTHER PUBLICATIONS

Written Opinion Report for PCT/EP2004/053725 (and English translation of).

* cited by examiner

CONNECTION SYSTEM FOR CONNECTING A FLAT BLOCK OF COMPONENTS TO AN APPARATUS

The present patent document is a national stage entry of PCT Application Serial Number PCT/EP2004/053725, filed Dec. 29, 2004, designating the United States, which is hereby incorporated by reference and which claims priority to German Application No. 10 2004 005 545.9, filed Feb. 4, 2004.

BACKGROUND

1. Field

The present embodiments relate to a connection system for connecting a contact of a flat block of components to an apparatus.

2. Related Art

Conventionally, a connection system has a cable harness. A conductive connecting element includes individual conductors of the cable harness, which are insulated from one another. The cable harness can be a disadvantage because there are multiple individual conductors that need to be connected, which increases the possibility that there will be incorrect electrical connections or short circuits. Thus, there is a need for a simplified connection system.

SUMMARY

The present embodiments are directed to a connection system that couples a contact of a flat block of components to an apparatus, which may obviate one or more of the problems due to the limitations and disadvantages of the related art.

In a preferred embodiment, the connection system that couples a contact of a flat block of components to an apparatus comprises a conductive connecting element. The connecting element is electrically coupled to the contact of the flat block of components. A clamping device is electrically coupled to the apparatus. The clamping device receives the connecting element. Accordingly, the connecting element electrically couples the apparatus and the contact of the flat block of components.

In a preferred embodiment, the connecting element is a rigid conductor, and the connecting element directly engages the clamping device of the apparatus. Accordingly, the connecting element is directly coupled to the clamping device. Because the connecting element is a rigid conductor that is coupled to the flat block of components, confusing the conductor with another conductor is prevented, and thus incorrect wiring is also prevented. In addition, plugs and fasteners for the flat block of components are no longer needed. Because the connecting element engages the clamping device of the apparatus directly, a compact construction of the connection system is furthermore attained.

In a first embodiment, the flat block of components is a printed circuit board. The rigid conductor is an extension or tongue of the printed circuit board material. The contact is a conductor track disposed on the extension of the printed circuit board material. In this embodiment, no additional components are needed to furnish the connecting element.

In a second embodiment, the rigid conductor is a metal bolt, which is electrically fastened directly to the contact of the flat block of components. Alternatively, the rigid conductor is a screw electrically fastened directly to the contact of the flat block of components. In this embodiment, the screw has a head and a shaft comprising a thread. The shaft is disposed in a bore in the flat block of components in the region of the contact. The screw is locked via a nut on a second side of the flat block of components, which is opposite a first side of the flat block of components.

In a third embodiment, the head of the screw is electrically coupled with the contact on the first side of the flat block of components. The nut of the screw is electrically coupled with the contact on the second side of the flat block of components. Accordingly, the contact and the connecting element are electrically coupled.

In another embodiment, the head and the nut of the screw are soldered or welded to the contact. Alternatively, the head or the nut of the screw is soldered or welded to the contact.

In a preferred embodiment, the flat block of components is an assembled printed circuit board. For example, the inverter is at least one rectifier. The inverter is connected to the apparatus via the connecting element and the clamping device.

In another exemplary embodiment, the clamping device is directly coupled to the apparatus. Alternatively, the clamping device of the apparatus is coupled to the apparatus via a securing robot that is electrically coupled to the apparatus. If a plurality of securing robots are used in a preferred embodiment, it is advantageous to have the securing robots disposed in a row on a distributor busbar.

When the connection system couples a plurality of contacts of the flat block of components to a plurality of clamping devices of the apparatus, the plurality of the connecting elements are disposed in accordance with the disposition of the clamping devices on the flat block of components.

In the preferred embodiments, the connection system is suitable for the apparatus. For example, the connection system is suitable for an apparatus, which is a transformer for a potential-free supply voltage for full bridge inverters of a magnetic resonance gradient amplifier.

In another embodiment, the clamping device is a screw terminal or a spring clip. For example, the connection between the at least one connecting element and the at least one clamping device can be disconnected.

In a preferred embodiment, the connection system is suited to conduct voltages of over 24 volts. In another preferred embodiment, the connection system is suited to conduct voltages over 120 volts, and even more preferably over 240 volts. In a preferred embodiment, the connection system is suited to conduct currents over 0.5 amperes. In another preferred embodiment, the connection system is suited to conduct currents over 1 ampere, and even more preferably over 10 amperes.

In the ensuing detailed description, the preferred embodiments will be described in terms of one exemplary embodiment in conjunction with the accompanying drawings. In the drawings, the same reference numerals identify the same elements.

BRIEF DESCRIPTION OF THE DRAWINGS

Further advantages, characteristics and details will become apparent from the ensuing exemplary embodiments and from the drawings. In the drawings:

FIG. 1' shows a top view of a rigid connector of the connection system of FIG. 1.

DETAILED DESCRIPTION OF THE PREFERRED EMBODIMENTS

Figure 1:
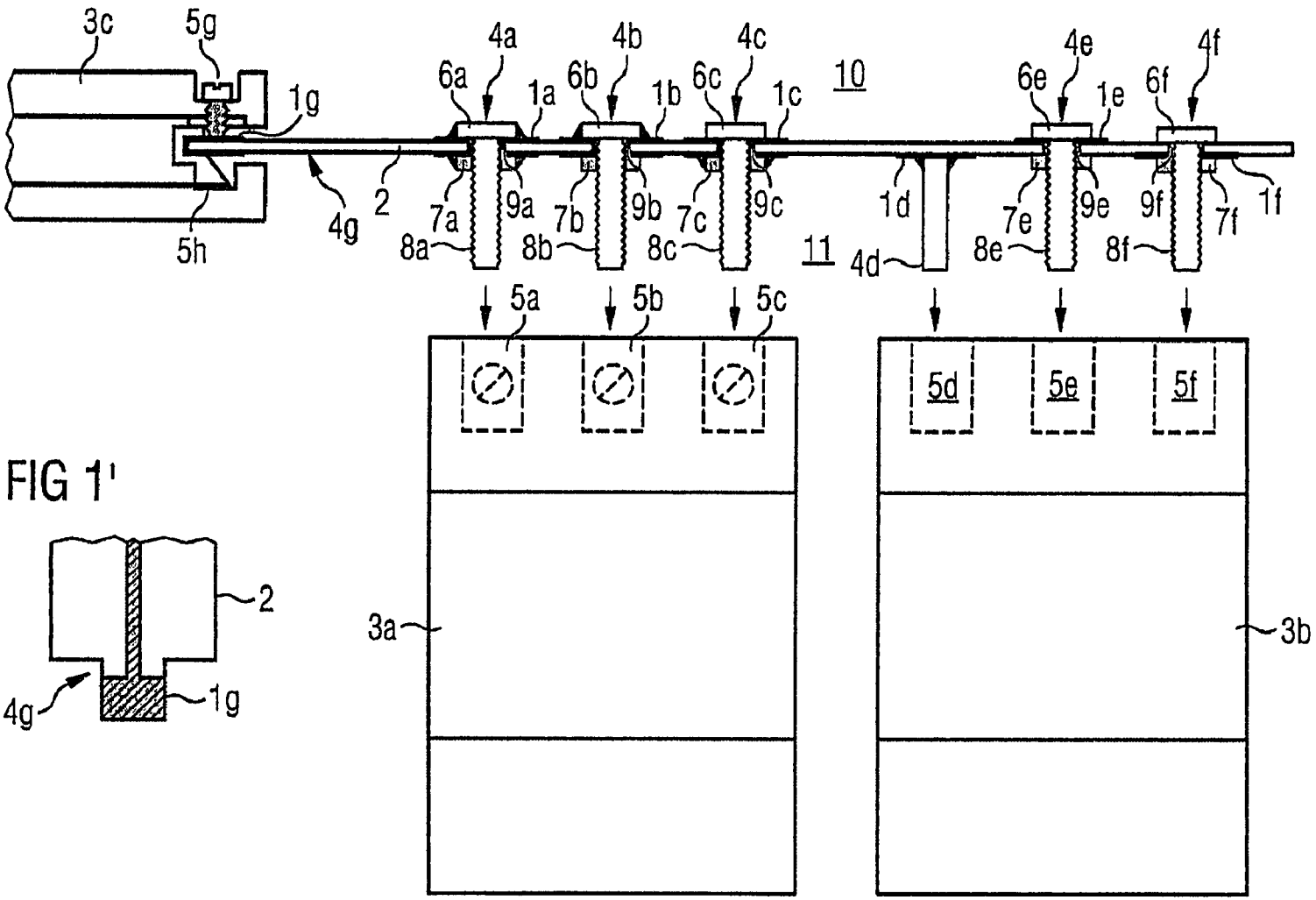
FIG. 1 schematically shows one exemplary embodiment of the connection system.

In FIGS. 1 and 1', the connection system of the invention is explained, for example, in the context of use with magnetic resonance gradient amplifiers.

The connection system serves to connect contacts 1*a*, 1*b*, 1*c*, 1*d*, 1*e*, 1*f*, and 1*g* of rectifiers (the rectifiers are not shown in FIG. 1) disposed on a printed circuit board 2 to transformers (hereinafter, the transformers may be referred to as transformers or robots) 3*a*, 3*b*, and 3*c*, which furnish a potential-free supply voltage for full bridge inverters, connected to the rectifiers, of a magnetic resonance gradient amplifier. The rectifiers together with the printed circuit board 2 form a flat block of components.

The inputs of the rectifiers are coupled to conductor tracks (not shown) disposed on the printed circuit board 2. The contacts 1*a*, 1*b*, 1*c*, 1*d*, 1*e*, 1*f*, and 1*g* of the inputs of the rectifiers are disposed on the printed circuit board 2 in accordance with the disposition of clamping devices 5*a*, 5*b*, 5*c*, 5*d*, 5*e*, 5*f*, and 5*g* of the transformers 3*a*, 3*b*, and 3*c*.

In FIG. 1, the transformer 3*a* has three clamping devices 5*a*, 5*b*, and 5*c*, each with a screw terminal (hereinafter, the clamping devices 5*a*, 5*b*, 5*c* may be referred to as clamping devices 5*a*, 5*b*, 5*c* and/or screw terminals 5*a*, 5*b*, 5*c*). The transformer 3*b* has three clamping devices 5*d*, 5*e*, and 5*f*, each with a spring clip (hereinafter, the clamping devices 5*d*, 5*e*, and 5*f*, may be referred to as clamping devices 5*d*, 5*e*, and 5*f* and/or sming clips 5*d*, 5*e*, and 5*f*). The transformer 3*c* is coupled to both a screw terminal 5*g* and a spring clip 5*h* (hereinafter, the clamping devices 5*g*, 5*h* may be referred to as clamping devices 5*g*, 5*h*; screw terminals 5*g*, 5*h*; and/or spring clips 5*g*, 5*h*).

As shown in FIG. 1', in a first embodiment, a portion of the printed circuit board material, which forms the printed circuit board 2, has a contact 1*g*. The contact 1*g* is a rigid conductor. The contact 1*g* is a connecting element 4*g* that connects to the transformer 3*c*, via the screw terminal 5*g* and the spring clip 5*h*. As shown in FIG. 1, the transformer 3*c* is embodied, by means of the clamping devices 5*g* and 5*h*, to receive at least one part of the tongue 4*g*, carrying the contact 1*g*, in order to furnish a direct electrical contact with the rectifiers disposed on the printed circuit boards 2. In this embodiment, the clamping devices 5*g* and/or 5*h* are connected to the electronic components of the transformer 5*c* and the rectifiers disposed on the printed circuit boards 2.

In another embodiment, screws 4*a*, 4*b*, and 4*c* are secured directly to the corresponding contacts 1*a*, 1*b*, and 1*c* of the printed circuit board 2. The screws 4*a*, 4*b*, and 4*c* each have a head 6*a*, 6*b*, and 6*c*, respectively, and a shaft 8*a*, 8*b*, and 8*c*. The shaft 8*a*, 8*b*, and 8*c* penetrates the bores 9*a*, 9*b*, and 9*c*, which are made in the printed circuit board 2 in the region of the contacts 1*a*, 1*b* and 1*c*. The shafts 8*a*, 8*b*, and 8*c* are electrically coupled to the bores 9*a*, 9*b*, and 9*c*. On a second side 11 of the printed circuit board 2, which is diametrically opposite the heads 6*a*, 6*b*, and 6*c* of the screws 4*a*, 4*b*, and 4*c*, the screws 4*a*, 4*b*, and 4*c*, are locked by nuts 7*a*, 7*b*, and 7*c*. As can be seen in FIG. 1, the contacts 1*a*, 1*b*, and 1*c* are disposed through the bore 9*a*, 9*b*, and 9*c* from a first side 10 oriented toward the heads 6*a*, 6*b*, and 6*c* of the screws 4*a*, 4*b*, and 4*c* to the second side 11. Accordingly, the head 6*a*, 6*b*, and 6*c* and the nuts 7*a*, 7*b*, and 7*c* and the shaft 8*a*, 8*b*, and 8*c* of the screws 4*a*, 4*b*, and 4*c* are electrically coupled to the contacts 1*a*, 1*b*, and 1*c* of the printed circuit board 2.

In a preferred embodiment, the head 6*b* and the nut 7*c* of the screws 4*b* and 4*c*, respectively, are soldered to the contacts 1*b* and 1*c* of the printed circuit board 2. In another preferred embodiment, both the head 6*a* and the nut 7*a* are soldered to the respective contact 1*a*. Accordingly, the screws 4*a*, 4*b*, and 4*c* are electrically connected or coupled to the contacts 1*a*, 1*b*, and 1*c* of the printed circuit board 2 by rigid connecting elements.

The screw terminals 5*a*, 5*b*, and 5*c* of the associated transformer 3*a* receive the screws 4*a*, 4*b*, and 4*c*. The screws 4*a*, 4*b*, and 4*c* electrically couple the transformer 3*a* and the respective contact 1*a*, 1*b*, and 1*c* of the printed circuit board 2. The screws 4*a*, 4*b*, and 4*c* directly engage the screw terminals 5*a*, 5*b*, and 5*c* of the transformer 3*a*. Accordingly, the transformer 3*a* is directly and immediately coupled to the screw terminals 5*a*, 5*b*, and 5*c*.

In an alternate embodiment, the transformer 3*b* has spring clips 5*d*, 5*e*, and 5*f* instead of screw terminals. The contacts 1*d*, 1*e*, and 1*f* of the rectifiers associated with the transformer 3*b* are disposed on only one side of the printed circuit board 2. The contact 1*d* is electrically coupled to the associated spring clip 5*d* of the transformer 3*b*. A metal bolt 4*d* is electrically secured by soldering the metal bolt 4*d* directly to the contact 1*d* of the printed circuit board 2. The associated spring clip 5*d* receives and electrically contacts the metal bolt 4*d*.

The screws 4*e* and 4*f* differ from the screws 4*b* and 4*c* only in that they are not soldered to the associated contacts 1*e* and 1*f*, respectively.

In another embodiment, the spring clips 5*e* and 5*f* are electrically coupled to the associated screws 4*e* and 4*f*, which directly engage the spring clips 5*e* and 5*f*. The transformer 3*b* is electrically coupled to the contacts 1*e* and 1*f*.

In the connection system of the preferred embodiments, an electrical connection is made via rigid conductors, such as metal bolts, screws, or printed circuit board extensions, and thus no separate mounts for the printed circuit board 2 are necessary. Mistakes in wiring can be avoided.

In an alternate embodiment, which is not shown, the elements 3*a* and 3*b* are securing robots, disposed in a row in a distributor busbar. An electrical connection is made between an arbitrary electrical apparatus, connected to the securing robots, and contacts of the printed circuit board 2.

While the invention has been described above by reference to various embodiments, it should be understood that many changes and modifications can be made without departing from the scope of the invention. It is therefore intended that the foregoing detailed description be regarded as illustrative rather than limiting and that it be understood that it is the following claims, including all equivalents, that are intended to define the spirit and scope of this invention.

The invention claimed is:

1. A connection system for connecting a contact of a flat block of components to an apparatus, the connection system comprising:

a conductive connecting element electrically coupled to the contact of the flat block of components; and a clamping device electrically coupled to the apparatus, wherein the clamping device receives the connecting element, wherein the connecting element is a rigid conductor, the rigid conductor being a screw fastened conductively to the contact, and wherein the screw penetrates a bore in the flat block of components and is locked by a nut on a second side of the flat block of components, which is opposite a first side of the flat block of components.

2. The connection system as defined by claim 1, wherein the flat block of components is a printed circuit board.

3. The connection system as defined by claim 2, further comprising an inverrer of a magnetic resonance gradient amplifier, the inverter comprising a rectifier, which is disposed on the printed circuit board and is coupled to the apparatus.

4. The connection system as defined by claim 1, wherein the connection system connects a plurality of contacts of the flat block of components to a plurality of clamping devices, including the clamping device, of the apparatus, and the connecting element is disposed on the flat block of components in accordance with the disposition of the clamping devices.

5. The connection system as defined by claim 1, wherein the clamping device is a screw terminal or a spring clip.

6. The connection system as defined by claim 1, wherein the connection system is suited to conduct voltages of over 24 volts, currents of over 0.5 ampere, or the combination thereof.

7. The connection system as defined by claim 1, wherein the clamping device is disposed directly on the apparatus or coupled to the apparatus via a separate securing robot electrically coupled to the apparatus.

8. The connection system as defined by claim 1, wherein the connecting element directly engages the clamping device of the apparatus.

9. The connection system as defined by claim 1, wherein the screw has a head which is electrically coupled with the contact on the first side of the flat block of components.

10. The connection system as defined by claim 1, wherein the nut is electrically coupled with the contact on the second side of the flat block of components.

11. The connection system as defined by claim 9, wherein the head of the screw is soldered or welded to the contact.

12. The connection system as defined by 1, wherein the nut is soldered or welded to the contact.

13. A flat block of components comprising:

a contact that is coupled to an apparatus, which is electrically coupled to a clamping device, and a conductive connecting element electrically coupled to the contact, wherein the conductive connecting element is a rigid conductor, the rigid conductor being a screw fastened electrically to the contact, wherein the screw penetrates a bore in the flat block of components and is locked by a nut on a second side of the flat block of components, which is opposite a first side of the flat block of components, and wherein the connecting element is directly coupled to the clamping device of the apparatus.

14. The connection system as defined by claim 13, wherein a plurality of securing robots are disposed in a row on a distributor busbar.

15. The connection system as defined by claim 14, wherein the apparatus is a transformer that furnishes a potential-free supply voltage for full bridge inverters of a magnetic resonance gradient amplifier.

16. The flat block of components as defined by claim 13, wherein the flat block of components is a printed circuit board.

17. The flat block of components as defined by claim 16, further comprising an inverter of a magnetic resonance gradient amplifier, the inverter comprising a rectifier which is disposed on the printed circuit board and is connected to the apparatus.

18. The flat block of components as defined by claim 13, wherein the screw has a head that is electrically coupled with the contact on the first side of the flat block of components.

19. The flat block of components as defined by claim 13, wherein the nut is electrically coupled wit the contact on the second side of the flat block of components.

20. The flat block of components as defined by claim 18, wherein the head of the screw is soldered or welded to the contact.

21. The flat block of components as defined claim 19, wherein the nut is soldered or welded to the contact.

* * * * *

UNITED STATES PATENT AND TRADEMARK OFFICE

CERTIFICATE OF CORRECTION

PATENT NO. : 7,425,149 B2
APPLICATION NO. : 10/588241
DATED : September 16, 2008
INVENTOR(S) : Siegfried Hofler et al.

It is certified that error appears in the above-identified patent and that said Letters Patent is hereby corrected as shown below:

In the Claims

In column 5, claim 3, line 2, after "comprising an" delete "inverrer" and substitute --inverter-- in its place.

In column 6, claim 19, line 31, after "electrically coupled" delete "wit" and substitute --with-- in its place.

Signed and Sealed this

Twelfth Day of May, 2009

JOHN DOLL
*Acting Director of the United States Patent and Trademark Office*